US010890179B2

(12) United States Patent
Andreis et al.

(10) Patent No.: US 10,890,179 B2
(45) Date of Patent: Jan. 12, 2021

(54) CONTAINER ASSEMBLY FOR A PUMP

(71) Applicant: FLUID-O-TECH GROUP S.R.L., Corsico (MI) (IT)

(72) Inventors: Diego Andreis, Milan (IT); Pierpaolo Lucchesi, Milan (IT)

(73) Assignee: FLUID-O-TECH GROUP S.R.L., Corsico (MI) (IT)

( * ) Notice: Subject to any disclaimer, the term of this patent is extended or adjusted under 35 U.S.C. 154(b) by 480 days.

(21) Appl. No.: 15/389,488

(22) Filed: Dec. 23, 2016

(65) Prior Publication Data

US 2017/0184098 A1 Jun. 29, 2017

(30) Foreign Application Priority Data

Dec. 24, 2015 (IT) ..... 202015000087713

(51) Int. Cl.

| | |
|---|---|
| ***F04C 15/00*** | (2006.01) |
| ***F04C 2/08*** | (2006.01) |
| ***F04C 11/00*** | (2006.01) |
| *F04C 2/14* | (2006.01) |

(52) U.S. Cl.

CPC ..... *F04C 2/086* (2013.01); *F04C 11/008* (2013.01); *F04C 15/0042* (2013.01); *F04C 15/0049* (2013.01); *F04C 2/14* (2013.01); *F04C 2240/30* (2013.01)

(58) Field of Classification Search

CPC .... F04C 2/086; F04C 11/008; F04C 15/0042; F04C 2240/30; F04C 2/14; F04C 29/0035; F04C 15/0049

USPC ..... 92/60; 417/540

See application file for complete search history.

(56) References Cited

U.S. PATENT DOCUMENTS

| | | | | |
|---|---|---|---|---|
| 2,344,628 A * | 3/1944 | Monahan | F04C 2/084 418/190 |
| 4,165,206 A * | 8/1979 | Martin | F04C 2/086 417/310 |
| 4,507,063 A * | 3/1985 | Kemmner | F04C 15/0049 138/30 |

(Continued)

FOREIGN PATENT DOCUMENTS

| | | |
|---|---|---|
| EP | 2273121 A2 | 1/2011 |
| WO | 2009029858 A1 | 3/2009 |

OTHER PUBLICATIONS

Merriam Webster Dictionary Definition for Possible, URL: https://web.archive.org/web/20151221183816/https://www.merriam-webster.com/dictionary/possible, published Dec. 21, 2015 (Year: 2015).*

*Primary Examiner* — Charles G Freay
*Assistant Examiner* — Thomas Fink
(74) *Attorney, Agent, or Firm* — King & Schickli, PLLC

(57) ABSTRACT

A container assembly (10) for a pump is described, provided with at least one pumping group (12, 14, 16, 18) and with at least one system (20) for transmitting power to such pumping group (12, 14, 16, 18). The container assembly (10) comprises at least one elastic element (26) sealingly housed inside such container assembly (10) at a predefined internal wall (28) thereof. Inside the elastic element (26), at least one cavity (32) is obtained which defines a corresponding air chamber configured for damping the variations of volume and the expansion of the fluid contained inside the pump following a possible change of state of the fluid itself when subjected to temperatures lower than its freezing point.

13 Claims, 3 Drawing Sheets

(56) References Cited

U.S. PATENT DOCUMENTS 5,035,588 A * 7/1991 Tuckey ..... F04C 15/0049 417/540
5,122,039 A * 6/1992 Tuckey ..... F04C 11/008 417/366
5,374,169 A * 12/1994 Talaski ..... F02M 37/0041 138/26
5,413,468 A * 5/1995 Tuckey ..... F02M 37/0041 417/366
5,538,355 A * 7/1996 Burr ..... F04C 15/0076 403/355
5,562,429 A * 10/1996 Romstad ..... B29C 49/4802 417/540
5,803,555 A * 9/1998 Schaefer ..... B60T 8/368 138/30
9,758,142 B2 * 9/2017 Doh ..... B60T 13/148
10,011,254 B2 * 7/2018 Her ..... B60T 8/4068
10,539,134 B2 * 1/2020 Afshari ..... F04C 2/18
2002/0076337 A1 * 6/2002 Rexroth ..... F04D 29/588 417/365
2009/0060728 A1 * 3/2009 Grimes ..... F04B 7/06 415/200
2012/0003107 A1 * 1/2012 Burns ..... F01C 21/10 417/410.4
2012/0133201 A1 * 5/2012 Zeoli ..... B60T 7/22 303/11
2013/0008544 A1 * 1/2013 Briesewitz ..... B60T 8/4068 138/30
2013/0017077 A1 * 1/2013 Hanisch ..... F04D 15/0077 415/204
2013/0230417 A1 * 9/2013 Kobayashi ..... F04B 11/0008 417/395
2016/0230767 A1 * 8/2016 Thompson ..... F04D 15/0066
2017/0057478 A1 * 3/2017 Her ..... B60T 8/4068
2017/0082105 A1 * 3/2017 Andreis ..... F04C 2/18
2018/0199681 A1 * 7/2018 Baker ..... F04B 7/06 415/200
2019/0368401 A1 * 12/2019 Yang ..... F04C 2/14

* cited by examiner

Fig.2
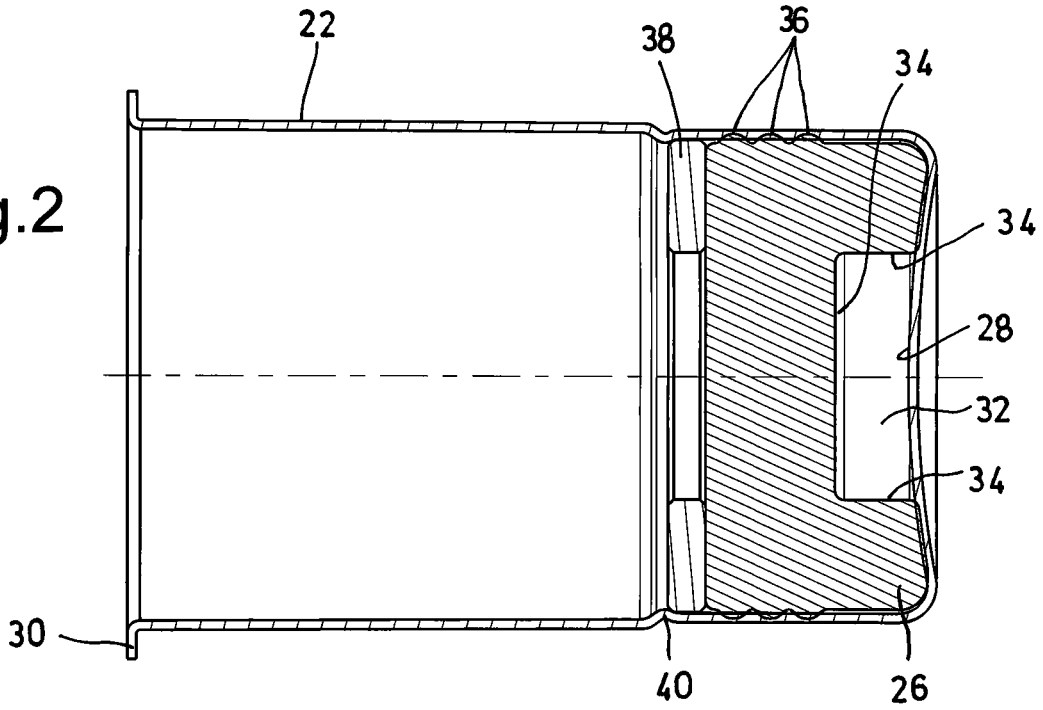
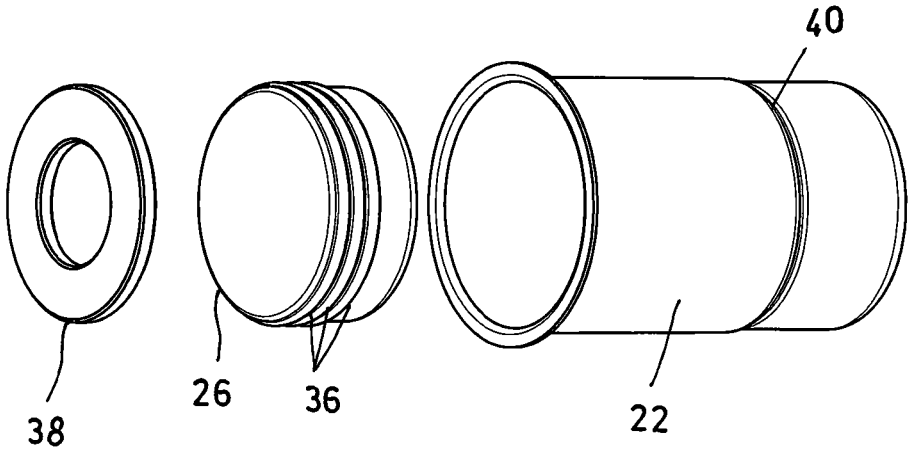
Fig.3

CONTAINER ASSEMBLY FOR A PUMP

The present invention refers to a container assembly for a pump, in particular but not exclusively an internal or external gear volumetric pump.

As it is known, a volumetric pump is a particular type of pump that exploits the variation of volume in a chamber in order to cause suction or pressure on an incompressible fluid. Among the volumetric pumps there are rotary pumps of the gear type, wherein the volume variation of the work chamber is obtained through the rotation of elements, typically two gear wheels that mesh with each other, capable of delimiting variable volume rotating chambers. Gear pumps are widely used in the field of lubrication and generally in all applications in which the liquid to be transferred is particularly viscous.

For example, the so-called internal gear pumps are constructed with the two gears arranged one inside the other but on offset axes. A partition assembly provides for separating the two gears by means of a half-moon-shaped partition baffle. The reduced pressure caused by the motion of the gears, when the respective teeth move away from each other, allows the entrance of the liquid into the cavity that is created between the teeth of the gears themselves. On the contrary, when the teeth of the gears approach to each other, an overpressure arises, which pushes the liquid towards the discharge area of the pump.

Power transmission in gear pumps, normally generated by an electric motor, can occur through the so-called "magnetic drive". This transmission system provides for the presence of two rings or coaxial magnetic cores, one of which is mounted on the drive shaft and the other on the rotor shaft, i.e. one of the gears of the pump. By applying a torque, the magnetic fields of the core mounted on the drive shaft approach those having an equal polarity of the core mounted on the shaft of the rotor and, due to the magnetic repulsion, they make it rotate.

Currently the components and the systems for transmitting power of the most common gear pumps are enclosed by sealed container vessels made of metal material, typically stainless steel. An inexpensive solution for packaging these components and closing the pump consists of bending the plate of a container cup on the body of the pump, e.g. by means of cold deformation (vertical pressing or lateral rolling).

Should the pump be operating at particularly low temperatures and should it be subjected to more or less long inoperative periods, the volume of the liquid to be pumped may increase due to the freezing of the liquid itself. Failure, by the sealed pump container vessel, to compensate for such volume increases may thus damage the internal mechanisms of the pump itself.

Document EP 2273121 A2, filed in the name of the same applicant, discloses a container assembly for a pump configured for compensating possible volume increases of the liquid contained inside the pump itself. However, in addition to these volume increases, during the normal pump operation excessive tolerances or "clearances" can be generated between the moving components of the pump itself. These clearances are mainly due to thermal expansions of the pump components that are verified in work conditions opposite those mentioned above, i.e. in the case of high temperatures. Regardless of the causes, these clearances can in any case compromise good pump operation.

Document WO 2009/029858 A1 discloses a pump, in particular a gear pump, capable of bearing an increase of volume of the liquid processed by the pump itself, e.g. in the case of freezing, pressure fluctuations or analogous situations. This situation type is frequently verified in the automotive field, where pumps are required, which are capable of managing the pressure increases caused by the decrease of temperature of the liquid, especially below its freezing point, without the risk of sustaining damage from thermal expansion.

The pump described in document WO 2009/029858 A1 is provided with at least one pressure compensator element manufactured with a specific material having softness properties. This pressure compensator element exploits its volumetric variation in order to compensate for the expansion due to the increase of volume of the fluid. Nevertheless, independent of the material with which the pressure compensator element is manufactured, this expansion can only have very limited size, since it is well known that the solid bodies (and also the pressure compensator element between them) are incompressible.

The general object of the present invention is therefore that of making a container assembly for a pump that is capable of resolving the abovementioned drawbacks of the prior art in an extremely simple, cost-effective and particularly functional manner.

In detail, one object of the present invention is to make a container assembly for a pump that is extremely compact, not having to exclusively exploit a volumetric variation thereof in order to compensate for the expansion due to the volume increase of the fluid.

Another object of the invention is to make a container assembly for a pump that has a suitable elasticity in order to compensate for the pressure pulses and the volume variation of the fluid following its freezing.

A further object of the invention is to make a container assembly for a pump that also ensures the seal of the power transmission system, typically but not exclusively constituted by a magnetic drive system, preventing the fluid from flowing into such power transmission system.

These objects according to the present invention are achieved by making a container assembly for a pump as outlined in claim 1.

Further characteristics of the invention are shown in the dependent claims, which are an integral part of the present description.

The characteristics and advantages of a container assembly for a pump according to the present invention will be clearer from the following exemplifying and non-limiting description, referred to the accompanying schematic drawings in which:

FIG. 2 is a section view of a specific portion of the container assembly for a pump of FIG. 1; and FIG. 3 is an exploded view of the main components of the container assembly portion for a pump of FIG. 2.

Figure 1:
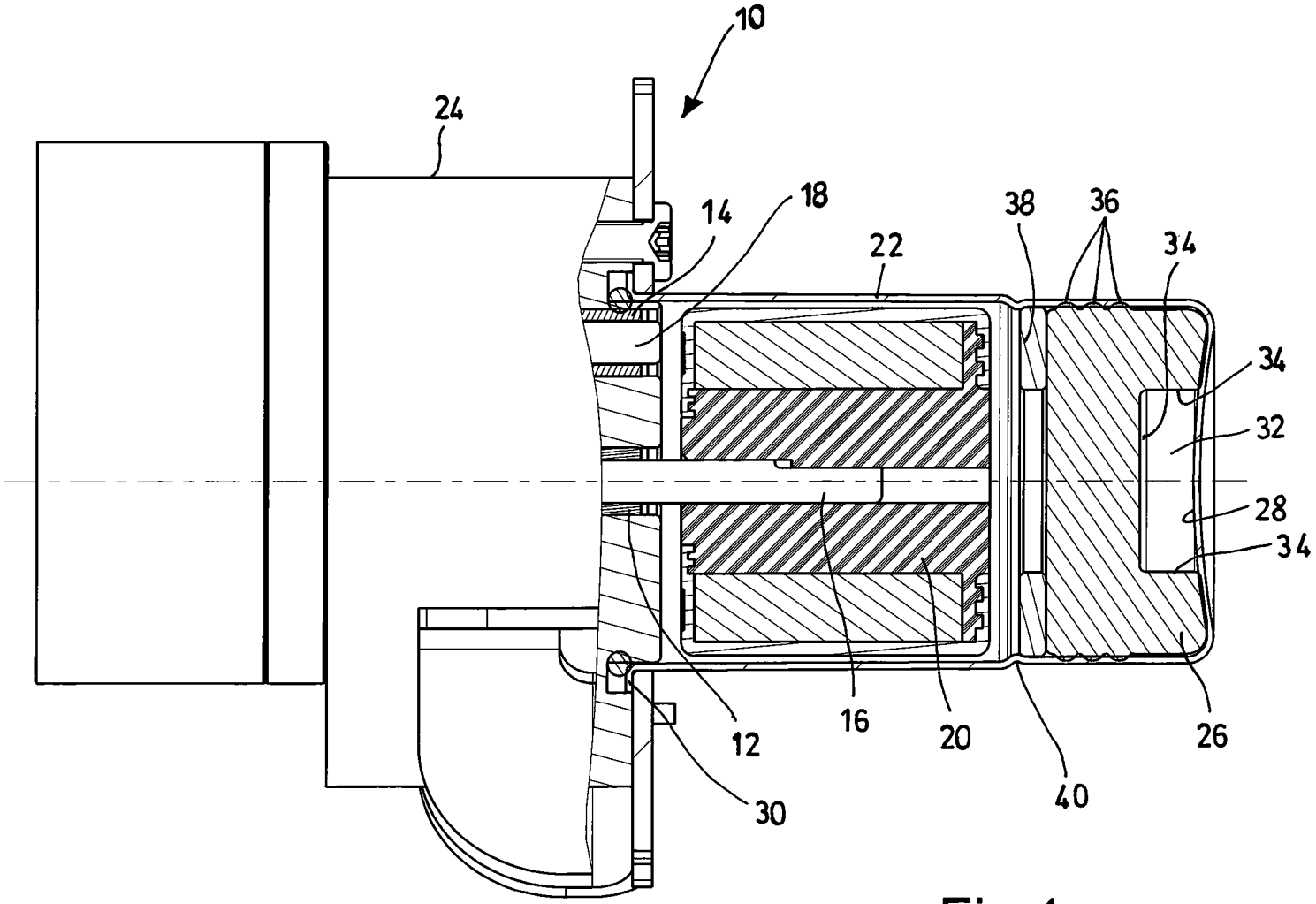
FIG. 1 is a side view, in partial section, of a container assembly for a pump made according to the present invention.
Figure 4:
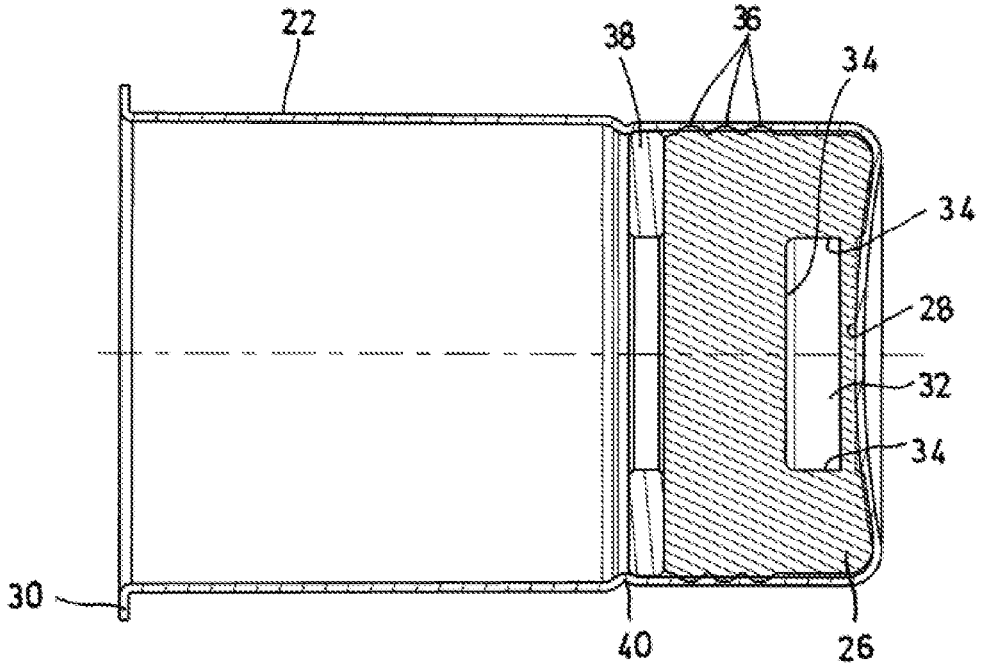

It is specified that, in the enclosed figures and in the following description, numerous pump components will not be mentioned and/or illustrated, since these are well-known components to the skilled person in the art.

With reference to the figures, a container assembly for a pump is shown, made according to the present invention, overall indicated with the reference number 10. The container assembly 10 is configured for being mounted on a generic pump internally provided with at least one pumping group and with at least one system for transmitting power to such pumping group.

In the embodiment shown in the figures, the pump is of the volumetric gear type and the respective pumping group comprises, in a per se known manner, a first gear 12, keyed on a first shaft 16, and a second gear 14, keyed on a second shaft 18. The first shaft 16 and the second shaft 18 are situated on axes that are different but parallel to each other, in such a manner that the first gear 12 can engage with the second gear 14. Therefore, during the rotation of the first gear 12 with respect to the second gear 14, the separation of the teeth of the two gears 12 and 14 causes the suction of the fluid inside the pump, whereas their rejoining causes the delivery of the fluid itself.

The power transmission system is also keyed on the first shaft 16 besides on the first gear 12, and is constituted in the current case by a magnet 20 driven by a typically electric motor. The container assembly 10 then comprises a first substantially cylindrical container vessel 22, called "cup" and provided with an opening at one of its two ends. The first container vessel 22 is preferably made of metal material and is configured for at least partially enclosing the power transmission system. The container assembly 10 also comprises at least one second container vessel 24, sealingly coupled with the first container vessel 22 at its open end and configured for hermetically enclosing, in cooperation with such first container vessel 22, at least part of the pumping group.

In another embodiment, not shown in the figures, the pump could still be of the volumetric gear type, but rather than have the gears keyed on the respective shafts, it could be provided with a first stationary shaft and with a second stationary shaft, with the respective first gear and second gear rotated around such stationary shafts. Nevertheless, it is not to be excluded that the pump could be of another type, e.g. without gears.

According to the present invention, the container assembly 10 comprises at least one elastic element 26 sealingly housed inside such container assembly 10 at one of its predefined internal wall 28. Preferably, the elastic element 26 is housed inside the first container vessel 22 at a terminal wall 28 thereof opposite its edge 30 of coupling with the second container vessel 24, in a manner such that the power transmission system is interposed between such elastic element 26 and the pumping group.

The elastic element 26 is preferably manufactured with a silicone rubber, but it can conveniently manufactured with any other material having elastic characteristics, whether made of plastic or metal. Advantageously, inside the elastic element 26, at least one cavity 32 is obtained which defines a corresponding air chamber. This air chamber is configured for damping the variations of volume (pulses) and the expansion of the fluid contained inside the pump following a possible change of state of the fluid itself when subjected to temperatures lower than its freezing point.

The air chamber is preferably obtained between the terminal wall 28 of the first container vessel 22 and a plurality of shaped walls 34 which form the cavity 32 of the elastic element 26. Alternatively, the air chamber could also be constituted by a cavity 32 completely incorporated in the material with which the elastic element 26 is manufactured.

The elastic element 26 can be provided with one or more sealing protuberances or edges 36 configured for maintaining the elastic element 26 itself sealingly stopped inside the container assembly 10, in the current case the first container vessel 22, as well as for preventing possible leakage of fluid inside the air chamber. At least one retention element 38 can also be provided, configured for maintaining the elastic element 26 sealingly stopped inside the container assembly 10, in combination with or not in combination with the sealing protuberances or edges 36 possibly obtained on the elastic element 26 itself.

The assembly constituted by the elastic element 26 and by the retention element 38 can be held in position inside the container assembly 10, in the current case the first container vessel 22, by means of an operation of caulking or riveting of a circumferential portion 40 of the surface of such container assembly 10, in particular obtained on the first container vessel 22. This operation, by generating a permanent deformation of the material that constitutes the first container vessel 22 and causing a consequent narrowing of the circumferential portion 40, is able to form a "mechanical stop" of the possible movement towards the pump side, i.e. the side of the container assembly 10 where the pumping group is housed, of the assembly constituted by the elastic element 26 and by the retention element 38.

It is thus seen that the container assembly for a pump according to the present invention attains the previously underlined objects, in particular obtaining the following advantages:

- it is extremely compact, since it does not exploit a volumetric variation thereof in order to compensate for the expansion due to the increase of volume of the fluid, but rather it operates thanks to its deformability and to the internal air chamber that its particular geometry is able to generate;
- it has an elasticity suitable for compensating for the pressure pulses and the volume variation of the fluid following its freezing;
- it carries out the primary function of ensuring the seal on the internal diameter of the magnet-cover cup (multiple sealing edges), preventing the fluid from reaching this part of the pump.

The container assembly for a pump thus conceived is in any case susceptible of numerous modifications and variations, all falling within the same innovative concept; in addition, all details can be replaced by technically equivalent elements. In practice, the materials used, as well as the shapes and sizes, can be of any type in accordance with the technical requirements.

The protective scope of the invention is therefore defined by the enclosed claims.

The invention claimed is:

1. Container assembly (10) for a pump provided with at least one pumping group (12, 14, 16, 18) and with at least one system (20) for transmitting power to said pumping group (12, 14, 16, 18), said at least one system having an axis of rotation, the container assembly (10) comprising at least one elastic element (26) sealingly housed inside said container assembly (10) at a predefined internal wall (28) thereof, the container assembly (10) being characterized in that inside on the surface of the elastic element (26), at least one cavity (32) is formed between a plurality of shaped walls (34) of said elastic element (26), adjacent to said predefined wall (28) of said container assembly (10) and said cavity being symmetrically aligned with and intersecting the axis of rotation, said cavity (32) and said predefined wall (28) of said container assembly (10) defining a corresponding air chamber, said air chamber being configured to allow deformation of said elastic element (26) for damping the variations of volume and the expansion of the fluid contained inside the pump following a change of state of said fluid when subjected to temperatures lower than its freezing point.

2. Container assembly (10) according to claim 1, characterized in that it comprises a first substantially cylindrical container vessel (22), provided with an opening at one of its two ends and configured for at least partially enclosing the power transmission system (20), and at least one second container vessel (24), sealingly coupled with the first container vessel (22) at its open end and configured for hermetically enclosing, in cooperation with said first container vessel (22), at least part of the pumping group (12, 14, 16, 18).

3. Container assembly (10) according to claim 2, characterized in that the elastic element (26) is housed inside the first container vessel (22) at the predefined internal wall (28) thereof, opposite its coupling edge (30) for coupling with the second container vessel (24), in a manner such that the power transmission system (20) is interposed between said elastic element (26) and the pumping group (12, 14, 16, 18).

4. Container assembly (10) according to claim 3, characterized in that the air chamber is obtained between the predefined internal wall (28) of the first container vessel (22) and the plurality of shaped walls (34) which form the cavity (32) of the elastic element (26).

5. Container assembly (10) according to claim 1, characterized in that the elastic element (26) is provided with one or more sealing edges or protuberances (36) configured for maintaining said elastic element (26) itself sealingly stopped inside the container assembly (10), as well as for preventing possible leakage of fluid inside the air chamber.

6. Container assembly (10) according to claim 1, characterized in that the container assembly (10) comprises at least one retention element (38) configured for maintaining the elastic element (26) sealingly stopped inside the container assembly (10).

7. Container assembly (10) according to claim 6, characterized in that the assembly constituted by the elastic element (26) and by the retention element (38) is held in position inside the container assembly (10) by a circumferential portion (40) of the surface of said container assembly (10), thereby generating a narrowing of said circumferential portion (40) which blocks a possible movement, towards the side of the container assembly (10) where the pumping group (12, 14, 16, 18) is housed, of the assembly constituted by the elastic element (26) and by the retention element (38).

8. Container assembly (10) according to claim 1, characterized in that the elastic element (26) is manufactured with a silicone rubber.

9. Container assembly (10) according to claim 1, characterized in that the pumping group comprises a first gear (12), keyed on a first shaft (16), and a second gear (14), keyed on a second shaft (18), said first shaft (16) and second shaft (18) being situated on axes that are different but parallel to each other in such a manner that the first gear (12) can engage with the second gear (14).

10. Container assembly (10) according to claim 1, characterized in that the power transmission system is constituted by a magnet (20) driven by an electric motor.

11. Container assembly (10) for a pump provided with at least one pumping group (12, 14, 16, 18) and with at least one system (20) driven by an electric motor for transmitting power to said pumping group (12, 14, 16, 18), the container assembly (10) comprising at least one elastic element (26) sealingly housed inside said container assembly (10) at a predefined internal wall (28) thereof, the container assembly (10) being characterized in that inside on the surface of the elastic element (26), at least one cavity (32) is obtained formed which defines a corresponding air chamber symmetrically aligned with and intersecting a rotation axis of the electric motor, said cavity (32) and said predefined wall (28) of said container assembly (10) together forming an air chamber, said air chamber being configured for damping the variations of volume and the expansion of the fluid contained inside the pump following a change of state of said fluid when subjected to temperatures lower than its freezing point, the container assembly further characterized in that it comprises at least one retention element (38) configured for maintaining the elastic element (26) sealingly stopped inside the container assembly (10);

wherein an assembly of the elastic element (26) and the retention element (38) are held in position inside the container assembly (10) by a circumferential portion (40) of the surface of said container assembly (10), thereby generating a narrowing of said circumferential portion (40) which blocks a possible movement, towards the side of the container assembly (10) where the pumping group (12, 14, 16, 18) is housed, of the assembly constituted by the elastic element (26) and by the retention element (38).

12. Pump provided with at least one pumping group (12, 14, 16, 18) having a shaft, with at least one system (20) keyed on the shaft for transmitting power to said pumping group (12, 14, 16, 18) and with a container assembly (10), said container assembly (10) comprising at least one elastic element (26) sealingly housed inside said container assembly (10) at a predefined internal wall (28) thereof, the container assembly (10) being characterized in that inside on the surface of the elastic element (26), at least one cavity (32) is formed between a plurality of shaped walls (34) of said elastic element (26), said cavity (32) and said predefined wall (28) together defining a corresponding air chamber symmetrically aligned with and intersecting a center axis of the shaft, said air chamber being configured to allow deformation of said elastic element (26) for damping the variations of volume and the expansion of the fluid contained inside the pump following a possible change of state of said fluid when subjected to temperatures lower than its freezing point.

13. Container assembly (10) for a pump provided with at least one pumping group (12, 14, 16, 18) and with at least one system (20) for transmitting power to said pumping group (12, 14, 16, 18), said at least one system having an axis of rotation, the container assembly (10) comprising at least one elastic element (26) sealingly housed inside said container assembly (10) at a predefined internal wall (28) thereof, the container assembly (10) inside the elastic element (26), at least one cavity (32) is formed between a plurality of shaped walls (34) of said elastic element (26) completely incorporated in the material with which the elastic element (26) is manufactured and symmetrically aligned with the axis of rotation, said cavity (32) defining a corresponding air chamber, said air chamber being configured to allow deformation of said elastic element (26) for damping the variations of volume and the expansion of the fluid contained inside the pump following a change of state of said fluid when subjected to temperatures lower than its freezing point.

* * * * *